US006143429A

United States Patent [19]

Abkowitz et al.

[11] Patent Number: 6,143,429

[45] **Date of Patent: *Nov. 7, 2000**

[54] TITANIUM/ALUMINUM COMPOSITE BAT

[75] Inventors: Stanley Abkowitz, Lexington; Susan M. Abkowitz, Winchester; Miles A. Abkowitz, Burlington; Harold L. Heussi, Essex; Paul F. Weihrauch, Newton, all of Mass.

[73] Assignee: Dynamet Technology, Inc., Burlington, Mass.

[ * ] Notice: This patent issued on a continued prosecution application filed under 37 CFR 1.53(d), and is subject to the twenty year patent term provisions of 35 U.S.C. 154(a)(2).

[21] Appl. No.: 08/672,628

[22] Filed: Jun. 28, 1996

[51] Int. Cl.[7] ..... A63B 59/06

[52] U.S. Cl. ..... 428/651; 473/566

[58] Field of Search ..... 428/650, 651, 428/655, 660, 615, 614; 273/72 A; 473/566

[56] References Cited

U.S. PATENT DOCUMENTS

| | | | |
|---|---|---|---|
| 3,615,279 | 10/1971 | Ward | 29/197 |
| 3,802,850 | 4/1974 | Cloughterty | 29/182.2 |
| 4,030,427 | 6/1977 | Goldstein | 109/82 |
| 4,113,248 | 9/1978 | Yanagibka | 273/72 A |
| 4,546,976 | 10/1985 | Jones | 273/72 R |
| 4,551,219 | 11/1985 | Flick et al. | 204/290 R |
| 4,731,115 | 3/1988 | Abkowitz et al. | 75/236 |
| 4,906,430 | 3/1990 | Abkowitz et al. | 419/6 |
| 4,961,576 | 10/1990 | Meredith | 273/80 B |
| 4,968,348 | 11/1990 | Abkowitz et al. | 75/244 |
| 5,415,398 | 5/1995 | Eggiman | 273/72 A |
| 5,511,777 | 4/1996 | McNeeley | 273/72 A |
| 5,578,384 | 11/1996 | Kingston | 428/608 |
| 5,620,652 | 4/1997 | Tack et al. | 420/532 |
| 5,676,609 | 10/1997 | Mollebaek | 473/564 |
| 5,722,908 | 3/1998 | Feeney et al. | 473/567 |
| 5,980,602 | 11/1999 | Carden | 75/236 |
| 6,053,828 | 4/2000 | Pitsenberger | 473/566 |
| 6,056,655 | 10/1997 | Feeney et al. | 473/567 |

FOREIGN PATENT DOCUMENTS

| | | |
|---|---|---|
| 7-163693 | 6/1995 | Japan . |
| 8-257187 | 6/1995 | Japan . |
| 10-314353 | 12/1998 | Japan . |

*Primary Examiner*—John J. Zimmerman
*Attorney, Agent, or Firm*—Finnegan, Henderson, Farabow, Garrett & Dunner, L.L.P.

[57] ABSTRACT

A light weight softball bat having a hitting surface made of a titanium material is provided. The bat according to the invention has improved strength and durability, and a lively hitting surface.

6 Claims, 1 Drawing Sheet

TITANIUM/ALUMINUM COMPOSITE BAT

This is a patent application which relates to Provisional Application Number 60/000,652 which was filed on Jun. 29, 1995.

BACKGROUND OF THE INVENTION

1. Field of the Invention

The present invention relates to softball bats.

2. Description of the Related Art

Baseball bats have traditionally been made out of wood. More recently, however, bat manufacturers have begun to use aluminum or other materials to improve on the inherent disadvantages of wood bats. In fact, aluminum baseball bats are such an improvement over wood bats that professional baseball has outlawed their use in order to maintain the careful balance between the pitcher's ability to get the batter out, and the batter's chances of getting a hit. However, other sports leagues, for example, amateur baseball or softball leagues, overwhelmingly use aluminum bats for their decided advantage over wood.

From the standpoint of durability, wood has several drawbacks. Most importantly, wood is a relatively weak material. For example, many batters prefer a thin handled bat for increased bat speed. Some major league batters are strong enough to break thin handled wooden bats with their bare hands in a checked swing. Many pitchers also intentionally pitch some batters inside, hoping to "saw" the bat in two with a hard fastball. A ball hit off of a broken bat is significantly slower than one hit off of an unbroken bat.

Moreover, wood is relatively soft and therefore prone to surface damage such as gouging or chipping. Wood will also warp in humid environments.

Aluminum, although being an improvement on the wooden bats, also has some drawbacks. For instance, aluminum is a relatively soft metal. Thus, an aluminum bat is prone to dents, cracks, scratching and other life decreasing surface damage.

In light of the foregoing, there is a need for a light weight softball bat having strength, durability, and a lively hitting surface.

SUMMARY OF THE INVENTION

Accordingly, the present invention is directed to a softball bat that substantially obviates one or more of the problems of the related art.

One object of the present invention is provide a softball bat which has improved strength and durability, while at the same time being lighter and more lively than traditional materials of manufacture.

Additional features and advantages of the invention will be set forth in the description which follows, and in part will be apparent from the description, or may be learned by practice of the invention. The objectives and other advantages of the invention will be realized and attained by the softball bat particularly pointed out in the written description and claims hereof as well as the appended drawings.

To achieve these and other advantages, and in accordance with the purposes of the invention, as broadly described, the invention includes a softball bat having a hitting surface comprised of a titanium material.

It is to be understood that both the foregoing general description and the following detailed description are exemplary and explanatory and are intended to provide further explanation of the invention as claimed.

The accompanying drawings are included to provide a further understanding of the invention and are incorporated in and constitute part of the specification, illustrate several embodiments of the invention and together with the description serve to explain the principles of the invention.

DETAILED DESCRIPTION OF THE PREFERRED EMBODIMENTS

The present invention is directed to a bat comprising: a body having a circular cross-section terminating in a generally spherical closed end. The body of the bat comprises an outer barrel having a hitting surface for a ball, wherein the hitting surface has a substantially constant diameter, and comprises a titanium material. The body of the bat also includes an inner barrel comprising an aluminum material, wherein the inner barrel is concentric with and extending substantially the length of the outer barrel. The bat further comprises a handle area remote from the hitting surface, which terminates in a radially enlarged knob, wherein there is a tapered region between the hitting surface and the handle area.

The bat according to the invention has a hitting surface comprised of a titanium material. The hitting surface is that portion which is used to contact the ball. For example, the hitting surface could be part a monolithic structure, i.e., the entire bat is made of the titanium material.

It is also possible to have a bi-metallic bat having a handle portion made of an aluminum material, and a separate hitting surface of titanium. These two separate sections are then joined together. The preferred bat, however, is a monolithic aluminum core having a titanium material clad thereto to form the hitting surface. As used herein, the term "core" refers to the central portion of the bat. This core is hollow, having a handle section and an upper barrel section. It is possible to use a conventional aluminum bat as a core for this invention. These bats have the advantage of using titanium in those portions where its properties provide the greatest advantage. The remainder of the bat is light weight aluminum, making these bats lighter weight than a monolithic titanium material bat.

Titanium is an excellent material from the standpoint of its strength and fracture resistance. It is also remarkably lightweight. Because of these properties it is ideally suited for use as the surface material for softball bats. As used herein, "titanium material" refers to any titanium based material such as commercially pure titanium, titanium alloys and titanium matrix composites.

A preferred titanium material for the purposes of this invention is a titanium alloy such Ti-6Al-4V or Ti-6Al-6V-2Sn. Even higher strength β alloys may also be used.

A second preferred titanium material for the purposes of this invention is a titanium matrix composite of a matrix of Ti-6Al-4V with TiC particles dispersed therein. This composite can be produced by a method such as powder metallurgy. During this process, blended elemental or master alloy powders are pressed and sintered to form an improved hitting surface. Such a composite is described in U.S. Pat. No. 4,371,115, incorporated herein by reference.

Figure 1:
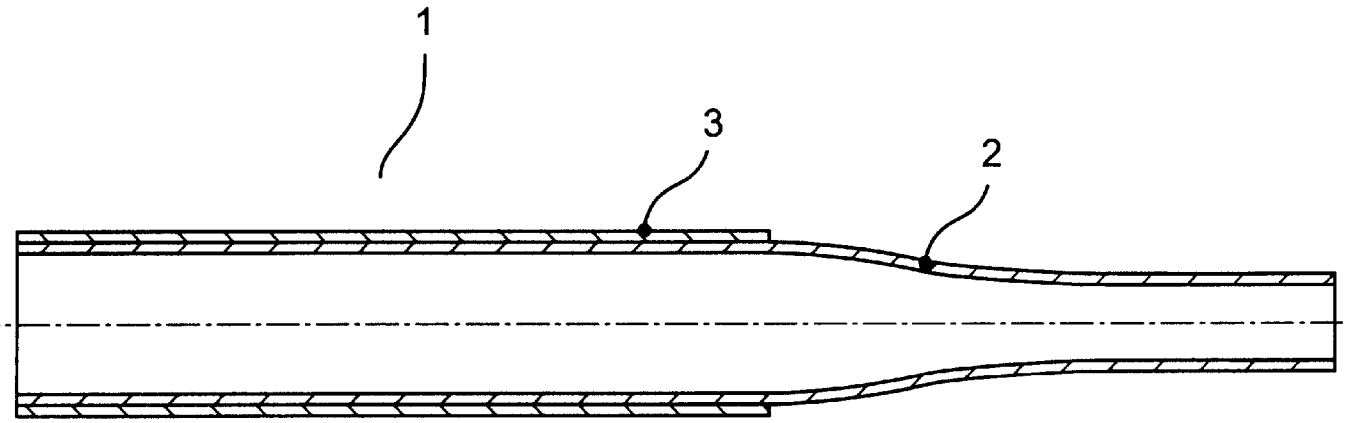
FIG. 1 is a partial longitudinal cross-sectional view of a softball bat according to the invention.
Figure 2:
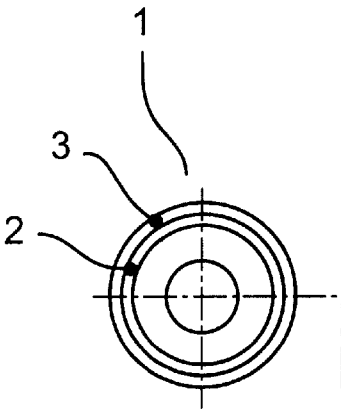
FIG. 2 is a radial cross-sectional view of the softball bat.

Such a composite can be used as the entire bat or, more preferably, to cover only a hitting surface. As shown in FIGS. 1 and 2, the preferred softball bat 1, is comprised of a core 2, and a hitting surface formed by an outer clad material or layer of a hard, titanium material 3. An aluminum material may be used as the core of the bat to which the titanium material is clad. A 7000 series high strength aluminum alloy is an example of a preferred aluminum core material.

Other composites may also be used to practice the invention. These composites and methods for manufacturing and cladding them are disclosed in U.S. Pat. Nos. 4,906,430 and 4,968,348, each of which is incorporated herein by reference. Thus, a bat comprised of a titanium material with reinforcing $TiB_2$ or TiB may be produced.

These titanium materials provide significant advantages over aluminum bats. For instance, the titanium materials are very hard compared to aluminum, and therefore more resistant to scratching.

The titanium materials also have higher strength and moduli than aluminum. These properties improve the bat's performance and durability. A ball hit off of them will be propelled with more velocity than one hit off an aluminum bat.

The titanium materials of the invention typically have properties allowing for thinner walls without sacrificing durability. By making the walls thinner, the bat will be more "lively" coming off the bat. A thinner walled bat of titanium will be as strong as or stronger than a comparable aluminum bat.

The titanium material also makes it easier to "tailor" a softball bat to an individual hitter's preference by uniformly distributing weight across the hitting surface. The relatively thin walls and uniform weight distribution, permit certain portions of the bat, such as the head or handle, to be custom weighted to suit an individual's hitting style without making the bat as a whole any heavier than a traditional aluminum bat.

The clad titanium material, especially the composite materials described herein, allow the manufacturer to customize the properties of the bat. For example, the liveliness of the bat can be tailored to meet a desired performance standard.

Finally, a bat made of the composite titanium material has an improved vibration damping capability. This capability is improved by both the material itself and the interface between the aluminum core and the cladding. The bat therefore has less "sting" when the ball is hit. The vibration damping can also be heard in the sound the bat makes. The bats of the invention do not make the "ping" sound normally associated with aluminum bats.

It will be apparent to those skilled in the art that various modifications and variations can be made in the bat of the present invention without departing from the spirit or scope of the invention. For instance, the term softball bat is used throughout this specification to refer to any bat used for a similar purpose, such as a softball bat. Thus, it intended that the present is invention cover the modifications and variations of this invention provided they come within the scope of the appended claims and their equivalents.

What is claimed is:

1. A bat comprising:

a body having a circular cross-section terminating in a generally spherical closed end, said body comprising:

an outer barrel having a hitting surface for a ball, said hitting surface having a substantially constant diameter, and comprising a titanium material, an inner barrel comprising an aluminum material, said inner barrel being concentric with and extending substantially the length of said outer barrel;

a handle area remote from said hitting surface and terminating in a radially enlarged knob; and a tapered region between said hitting surface and said handle area.

2. The bat of claim 1, wherein the hitting surface is selected from the group consisting of Ti-6Al-4V, Ti-6Al-6V-2Sn, Ti-6Al-2Sn-4Zr-2Mo, Ti-10V-2Fe-3Al, Ti-5Al-2.5Sn, or β alloys, wherein the amounts of Ti, Al, V, Sn, Zr, Mo and Fe are in weight percent.

3. The bat of claim 1, wherein the hitting surface is a titanium metal matrix composite that is reinforced with particles or particulates of TiC, TiB or $TiB_2$.

4. The bat according to claim 1, wherein the handle comprises an exposed portion of the aluminum material.

5. The bat according to claim 1, wherein the titanium material extends onto the tapered region.

6. The bat according to claim 2, wherein the hitting surface is Ti-6Al-6V-2Sn.

* * * * *